US006216518B1

(12) United States Patent
Sakurai et al.

(10) Patent No.: US 6,216,518 B1
(45) Date of Patent: Apr. 17, 2001

(54) METHOD OF ADJUSTING POSITION IN BAR STEEL ROLLING MILL AND ROLL POSITION ADJUSTING GUIDANCE APPARATUS

(75) Inventors: Tomoyasu Sakurai; Takao Ogawa, both of Kurashiki (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/497,479

(22) Filed: Feb. 4, 2000

(30) Foreign Application Priority Data

Feb. 19, 2000 (JP) ..... 11-042281

(51) Int. Cl.[7] ..... B21B 31/07; B21B 31/20

(52) U.S. Cl. ..... 72/240

(58) Field of Search ..... 72/224, 8.1, 9.5, 72/247, 10.1, 13.4, 240

(56) References Cited

U.S. PATENT DOCUMENTS 3,574,280 * 4/1971 Smith, Jr. ..... 72/8.1
5,467,625 * 11/1995 Holthoff ..... 72/35

FOREIGN PATENT DOCUMENTS 6-167313 6/1994 (JP) .
8-5343 1/1996 (JP) .

* cited by examiner

*Primary Examiner*—Rodney A. Butler
(74) *Attorney, Agent, or Firm*—Oliff & Berridge PLC

(57) ABSTRACT

A method of adjusting a roll position in a bar steel rolling mill includes using portions of a roll caliber, that are located at approximately symmetrical positions with respect to a rolling reduction direction, as sensing positions, and calculating the sum of, and the difference between, the areas located between a reference profile and an actually measured profile at the sensing positions.

15 Claims, 5 Drawing Sheets

METHOD OF ADJUSTING POSITION IN BAR STEEL ROLLING MILL AND ROLL POSITION ADJUSTING GUIDANCE APPARATUS

BACKGROUND OF THE INVENTION

1. Field of Invention

The present invention relates to roll position alignment that is carried out after rolls are assembled in a bar steel rolling mill. In particular, the present invention relates to a method of adjusting a roll position using a roll caliber and a guidance apparatus for adjusting the roll position.

2. Description of Related Art

In general, the position of a roll assembled in the housing of a bar steel rolling mill is directly visually adjusted by a worker using a gauge or the like.

There is also a method of using an optical gauge. According to this method, the overall image of a roll caliber is enlarged to several tens of times of its actual size and projected onto a screen. Then, a worker visually adjusts a roll position so that the reference profile of the roll caliber displayed on a projecting surface corresponds with the projected image. The roll caliber is a curved position for connecting the points at which a roll is in contact with a material to be rolled and determined by the roll position, the roll surface shape, and the like, in a rolling mill.

In the visual roll position adjusting method, however, the amount of adjustment cannot be quantitatively obtained even if an optical gauge is used. Accordingly, the roll adjustment does not have good accuracy and greatly depends on a worker's skill. The roll position adjusting job is also called a centering job. Moreover, because the adjusting job alone may require a long amount of time depending upon the degree of skill of the worker, there is also a problem that working efficiency is poor.

To address the above problems, Japanese Unexamined Patent Publication Nos. 6-167313 and 8-5343 propose a method of measuring the caliber profile of a roll caliber using image processing and determining the center and the radius of an affine circle corresponding to the thus obtained caliber profile. With this method, it is possible to automatically measure a roll position and to adjust the roll position based on a determined affine circle.

In the method disclosed in Japanese Unexamined Patent Publication No. 6-167313, however, sufficient accuracy cannot be obtained because the roll position is adjusted only by the profile of an actual caliber.

Further, in the methods disclosed in both of the above-mentioned publications, an overall caliber profile must be expressed with an affine circle. For this purpose, measurement must be carried out at many points, whereby control is made complicated.

Moreover, the methods disclosed in both of the above-mentioned publications mainly make use of the profile of the arc portion of a roll caliber in the vicinity of the center of the role caliber in an axial direction. The roll caliber is more worn at its center in the axial direction in rolling. Consequently, there is a possibility that an error is included in an amount corresponding to the amount of wear with respect to the coordinates of the determined affine circle. Thus, there is a possibility that positional accuracy is deteriorated by the amount of error due to the wear.

SUMMARY OF THE INVENTION

The present invention has been made in view of the above problems. An object of the present invention is to provide a roll position adjusting method of a bar steel rolling mill and a roll position adjusting guidance apparatus that can accurately adjust a roll position by a simple system.

The present invention relates to a method of adjusting a roll position in a bar steel rolling mill by using two portions of a roll caliber, which are located at approximately symmetrical positions with respect to a rolling reduction direction, as sensing positions and determining the sum of, and that difference between, the areas located between the reference profile and the actually measured profile at the two sensing positions. The present invention is applicable, for example, to any one of a two-roll rolling mill, a three-roll rolling mill, and a four-roll rolling mill, as the bar steel rolling mill.

In some embodiments, it is preferable that the sensing positions are located at material escape portions at both of the ends of a roll in a roll axial direction, and that the actually measured profile of the sensing positions is extracted by subjecting video signals of the sensing positions of the rolls to image processing.

Exemplary embodiments of the roll position adjusting guidance apparatus of the present invention can comprise a roll caliber illuminating device, a video signal input device that inputs the video signals of the sensing positions of a roll caliber at the two portions of the roll caliber located approximately symmetrically with respect to a rolling reduction direction, an image processing apparatus that determines the actually measured profile of the sensing positions based on the video signals, and a determining device that determines a guidance in the rolling reduction direction from the sum of the areas located between the actually measured profile and the reference profile at the sensing positions, and a guidance in the roll axial direction from the difference between these areas.

According to the present invention, an error due to wear of the roll caliber can be reduced to a low level because the roll position is adjusted making use of both of the ends of the roll caliber in the roll axial direction, which are less worn by rolling as compared with the central portion of the roll caliber in the axial direction of the roll caliber.

Further, because the sensing positions are located at only a portion of the roll caliber, the roll position can be adjusted without being affected by the complex shape of the roll at the central portion of the roll in the roll axial direction. Therefore, the calculations and the like in the image processing can be simplified. Further, the amounts of location discrepancy of the roll in the rolling reduction direction and the roll axial direction and the dislocating directions of the roll can be simply determined from the sum of, and the difference between, the areas located between the reference profile and the actually measured profile of the roll caliber at the sensing positions. That is, the guidances for the adjustment of the roll position can be simply provided quantitatively. In particular, the employment of the material escaping portions located at both of the ends of the roll caliber as the sensing positions is advantageous in the simplification and the accuracy of the calculation of the areas and the like, because the material escaping portions are less worn by rolling in the roll caliber and further have a linear or a smooth curved profile.

DETAILED DESCRIPTION OF THE PREFERRED EMBODIMENTS

Figure 1:
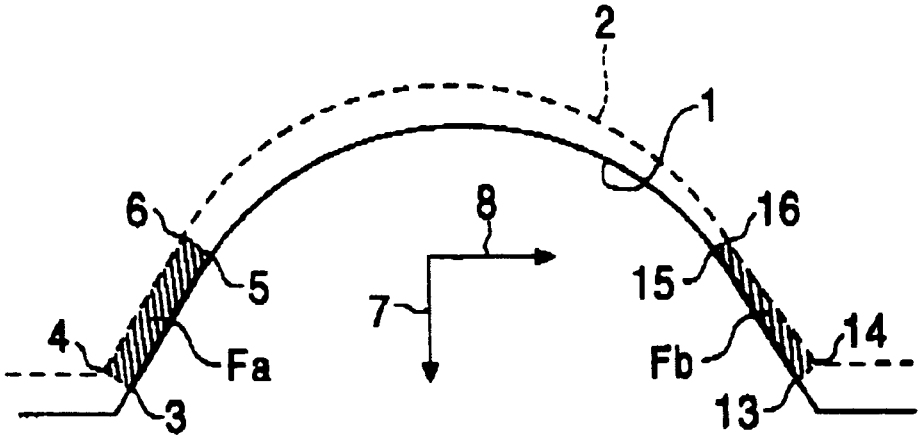
FIG. 1 illustrates an example of a reference profile and an actually measured profile at sensing positions according to an exemplary embodiment of the present invention.

In FIG. 1, a reference roll caliber 1 is shown by a solid line and an actual roll caliber 2 is shown by a broken line. Sensing positions are located at a 3–5 portion and a 13–15 portion on the reference roll caliber 1. Sensing positions are located at a 4–6 portion and a 14–16 portion located on the actual roll caliber 2. There portions on the reference roll caliber 1 are called a reference profile, and these portions on the actual roll caliber 2 are called an actually measured profile. Further, the area of the hatched portion defined by 3-5-6-4 is denoted by Fa, and the area of the hatched portion defined by 13-15-16-14 is denoted by Fb. In addition, a rolling reduction is shown by an arrow 7 and a roll axial direction is shown by an arrow 8.

When the actually measured profile is located below the reference profile, the areas Fa and Fb are represented by negative values, whereas when the actually measured profile is located above the reference profiles, the areas Fa and Fb are represented by positive values. Hereinafter, description will be made based on the above setting. However, the setting of the positive values and the negative values are not limited to the above setting.

As shown in FIG. 1, when the actually measured profile is located above the reference profile, both Fa and Fb are set to positive values. Thus, it can be found that an actual roll position is dislocated upward form a reference roll position by an amount proportional to the sum of the actual and reference roll positions. Inversely, when the actually measured profile is located below the reference profile, both Fa and Fb are set to negative values. Thus, it can be found that the actual roll position is dislocated downward form the reference roll position by an amount proportional to the sum of the actual and reference roll positions.

While a roll is dislocated leftward in the roll axial direction in FIG. 1, it can be found that it is in coincidence with the Fa side, that is, the side having a larger area. Accordingly, it can be found that the roll is dislocated to the side having the larger area by an amount proportional to the difference between Fa and Fb.

Figure 2:
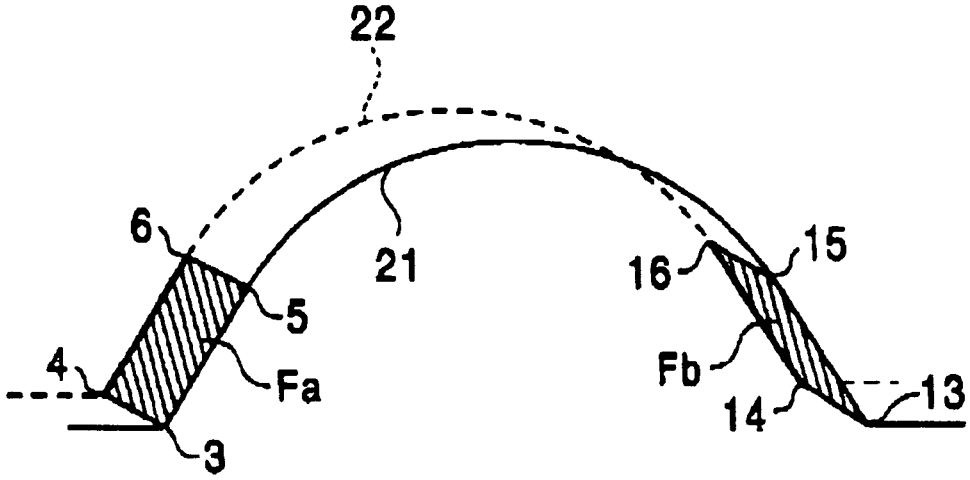
FIG. 2 shows an example of the reference profile and the actually measured profile at the sensing positions according to an exemplary embodiment of the present invention.

This is also applicable likewise even if a reference roll caliber 21 is across an actual roll caliber 22 as shown in FIG. 2. It is sufficient to process the areas Fa and Fb calculated from the reference profile and the actually measured profile as positive values or negative values according to the above definition. Fb is set to a negative value in FIG. 2.

As described above, the sum of Fa and Fb is proportional to the location discrepancy of the roll in the rolling reduction direction. Further, the difference between Fa and Fb is proportional to the roll axial direction. Moreover, the directions in which the roll is dislocated can be determined depending upon whether the sum of, and the difference between, Fa and Fb is positive or negative.

Then, the roll can be adjusted to an ideal position by adjusting the position thereof in the rolling reduction direction and in the roll axial direction so that the sum of, and the difference between, Fa and Fb approaches zero from the amounts of location discrepancy in the two directions, and the directions of location discrepancy, which have been determined as described above. The amounts of adjustment and the adjusting directions are called guidances.

Next, an embodiment of the present invention will be described with reference to the drawings.

Figure 3:
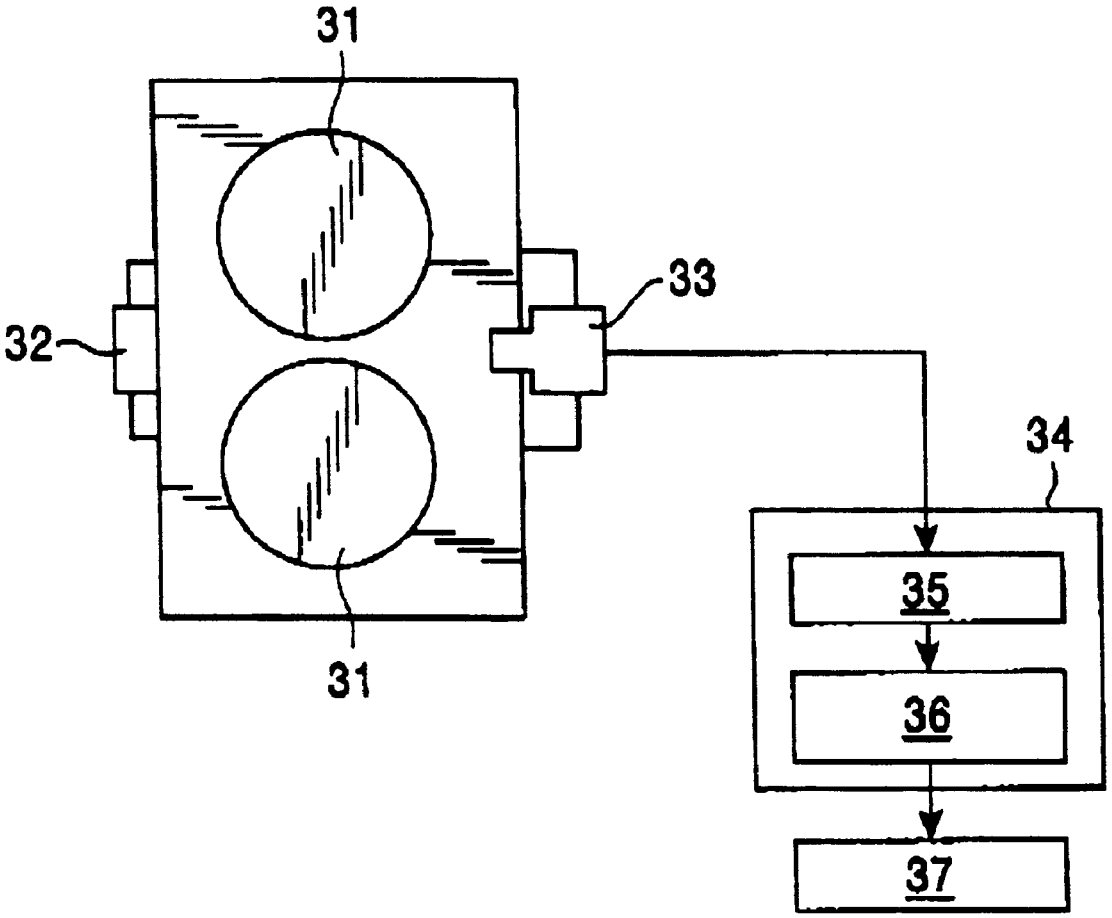
FIG. 3 illustrates an apparatus according to an exemplary embodiment of the present invention in a two-roll rolling mill.

FIG. 3 shows an exemplary embodiment in which the present invention is employed in a two-roll rolling mill for rolling wire rod and steel bar. An illuminating device 32 is mounted on a guide mounting surface on the inlet side of the rolling mill so as to illuminate the calibers of rolls 31 along a rolling direction. A video input device is mounted on a guide mounting surface on the outlet side of the rolling mill. In the example shown in FIG. 3, a CCD camera 33 is mounted on the video input device. The video of each caliber of the rolls 31 is input to eh CCD camera 33, and the video signal of the CCD camera 33 can be supplied to a determining device that can be a calculating device 34. The calculating device 34 includes an image processing device 35 and a guidance calculating device 36. The image processing device 35 subjects the video signals form the CCD camera 33 to image processing, such as binary processing and the like, and extracts the actually measured profile of a sensing position and supplies the coordinates of the profile to the guidance calculating device 36. A coordinate system used in the calculating device 34 uses the center of a caliber as a point of origin, a roll axial direction is set on the X-axis, and a rolling reduction direction is set on the Y-axis as shown, for example, in FIG. 4. The coordinates of the reference profile of each roll 31 to be processed are preset to the guidance calculating device 36. The guidance calculating device 36 calculates the respective areas Fa and Fb between the reference profile and the actually measured profile at the right and left sensing positions based on the coordinates of the reference profile at the sensing positions and the coordinates of the actually measured profile supplied form the image processing device 35. Subsequently, the guidance calculating device 36 calculates the amount of location discrepancy $S_R$ in the rolling reduction direction and the amount of location discrepancy $S_A$ in the roll axial direction from the following formulas (1) and (2). $S_R$ and $S_A$ can be supplied to a display 37 (FIG. 3) as guidances. The absolute values of $S_R$ and $S_A$ correspond to the amounts of guidance and the positive and negative signs of $S_R$ and $S_A$ correspond to guidance directions.

$$S_R=K_1\cdot(Fa+Fb) \quad (1)$$

$$S_A=K_2\cdot(Fa-Fb) \quad (2)$$

where, $K_1$ and $K_2$ are proportionality constants.

In the emboidment, the values $S_R$ and $S_A$, which approximate actual amounts of location discrepancy, are displayed as the guidances. However, the guidances are not limited to these guidances and may be displayed by being converted into amounts of operation, such as angles of rotation and operating directions, or the like.

Figure 4:
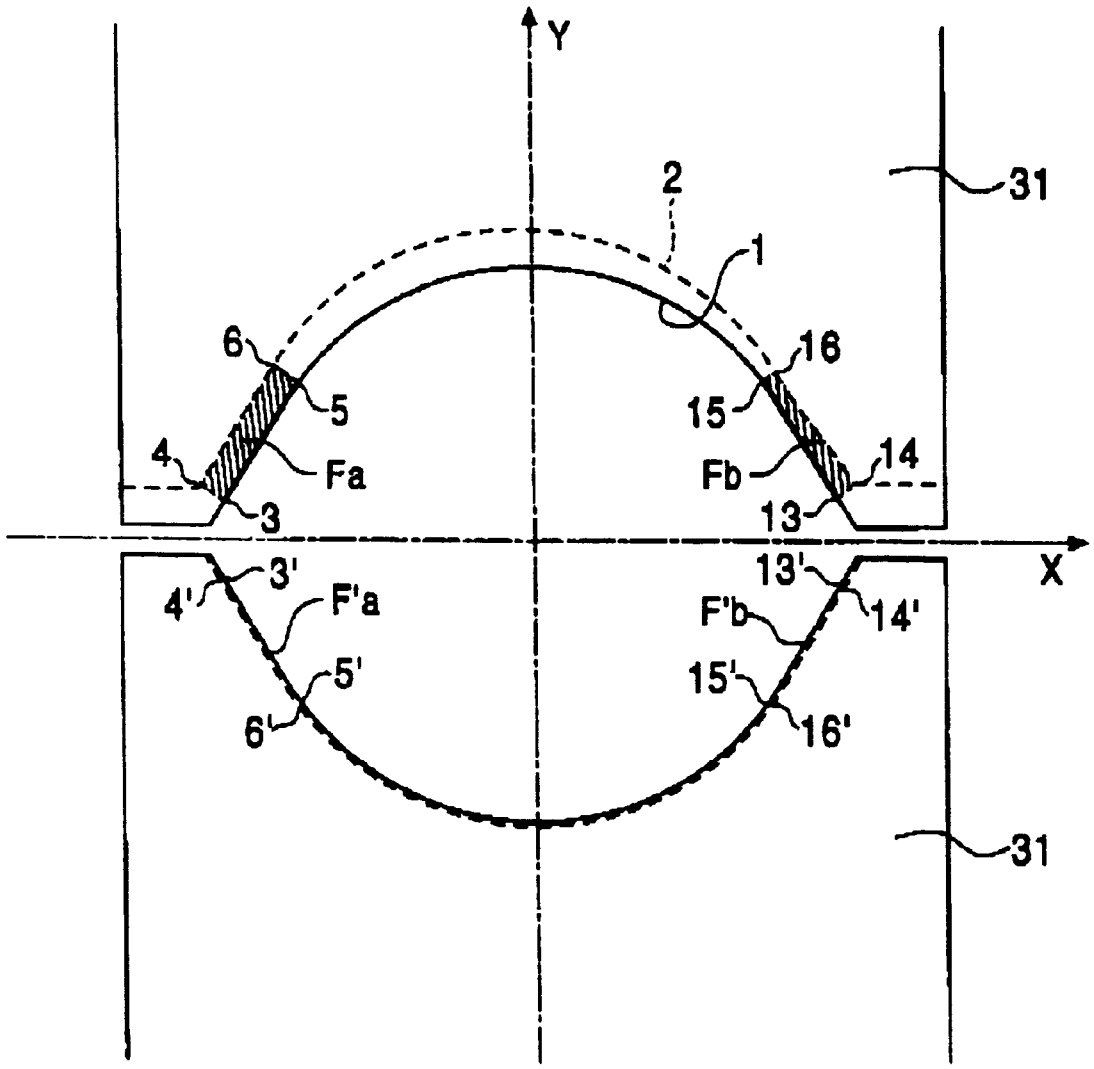
FIG. 4 illustrates roll calibers according to an exemplary embodiment of the present invention in the two-roll rolling mill.

In addition, material escaping portions are used as the sensing positions in the emboidment. The material escaping portions are located at both of the ends of each caliber in the roll axial direction, that is, a 3–5 portions and a 13–15 portion, which are actually measured on one of the roll calibers as shown in FIG. 4.

A roll position is adjusted by the following procedure using the apparatus as described above.

a. Each roll caliber is illuminated along the rolling direction by the illuminating device 32.

b. The image of the roll calibers is captured with the camera 33 and converted to a video signal.

c. The video signal is processed by the image processing device 35 and an actually measured profile at the sensing positions, which are symmetrical about the roll axial direction (X-axis direction) in the caliber, is extracted.

d. The areas Fa and Fb between the reference profile in an ideal state, which was previously stored, and the actually measured profile at the two sensing positions, are calculated from the coordinates of the reference profile and the coordinates of the actually measured profile at the sensing positions.

e. Guidances in the rolling reduction direction and the roll axial direction are calculated based on Fa and Fb and displayed on the display 37.

f. A worker adjusts the positions of the roll of interest in the rolling reduction direction and the roll axial direction based on the displayed guidances.

The above procedures a–f are repeated until the absolute values of the guidances in the rolling reduction direction and the roll axial direction, which are displayed on the display unit, are equal to zero, or set to within a desired range, which can be a predetermined allowable range.

The procedures a–f are carried out for both of the upper and lower rolls in the two-roll rolling mill of the embodiment.

The following result was obtained in the example shown in FIG. 1 in which the caliber for 50 mmϕ bar steel product was employed.

The example required only two minutes to process the upper and lower rolls using the portions 1.0 mm and 6.0 mm from both of the ends of the rolls as sensing positions until $S_R \leqq 0.5$ and $S_A \leqq 0.25$. The deviation of a rolled material diameter was less than 0.1 mm during this time.

It is required ten minutes of working time for a skilled worker to obtain the same degree of dimensional accuracy visually as achieved by this invention.

Further, the same degree of dimensional accuracy achieved by this invention could not be obtained by the adjusting method of calculating the affine circle of the caliber profile.

As described above, the roll positions of a pair of upper and lower rolls can be simply adjusted to approach or reach target positions in a short amount of time only be repeatedly moving the roll positions according to the guidances displayed on the display regardless of the degree of skill of the worker.

That is, the dimensional accuracy of a product greatly depends on the roll position adjusting job in the rolling of bar steel. Because an amount of adjustment (amount of guidance) of a roll position can be simply displayed quantitatively during the image processing, the roll position can be adjusted with high accuracy in a short amount of time without the need of a skilled worker.

Figure 5:
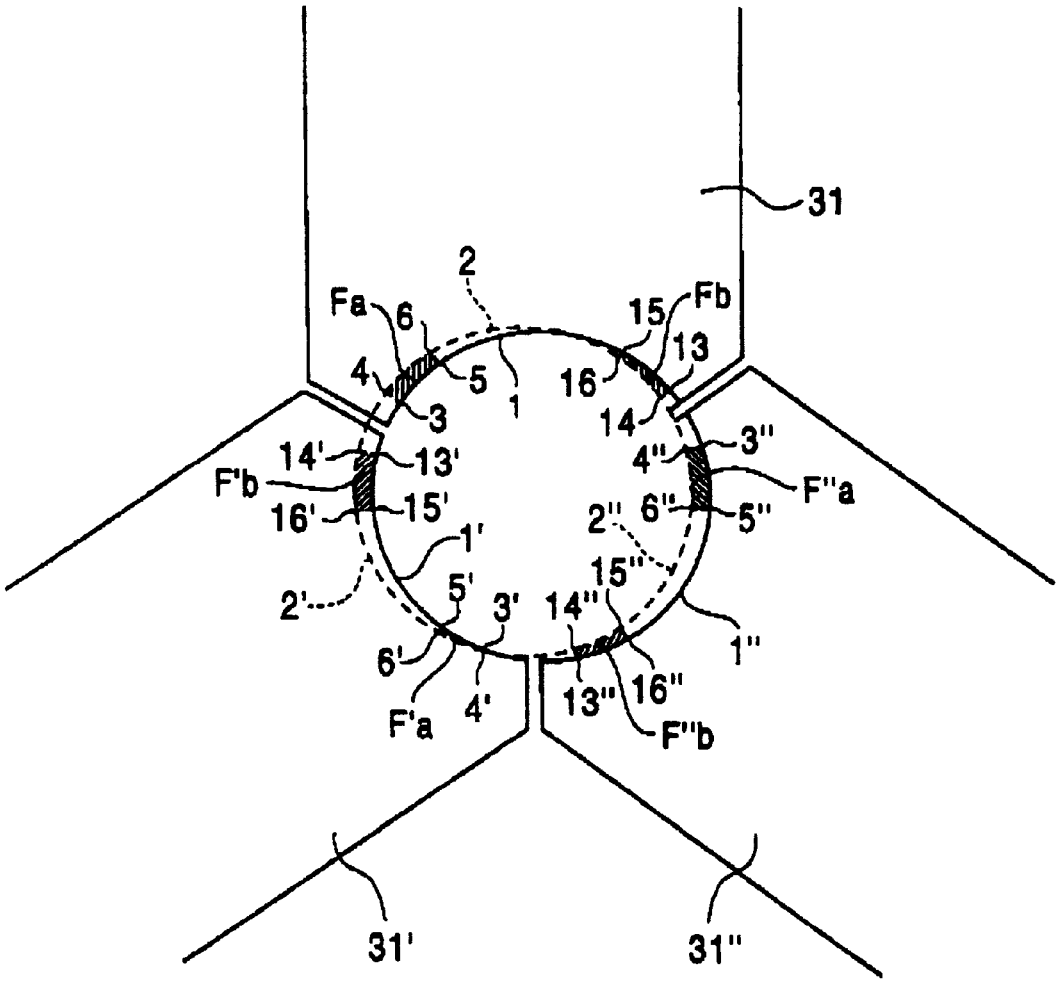
FIG. 5 illustrates roll calibers according to an exemplary embodiment of the present invention in a three-roll rolling mill.
Figure 6:
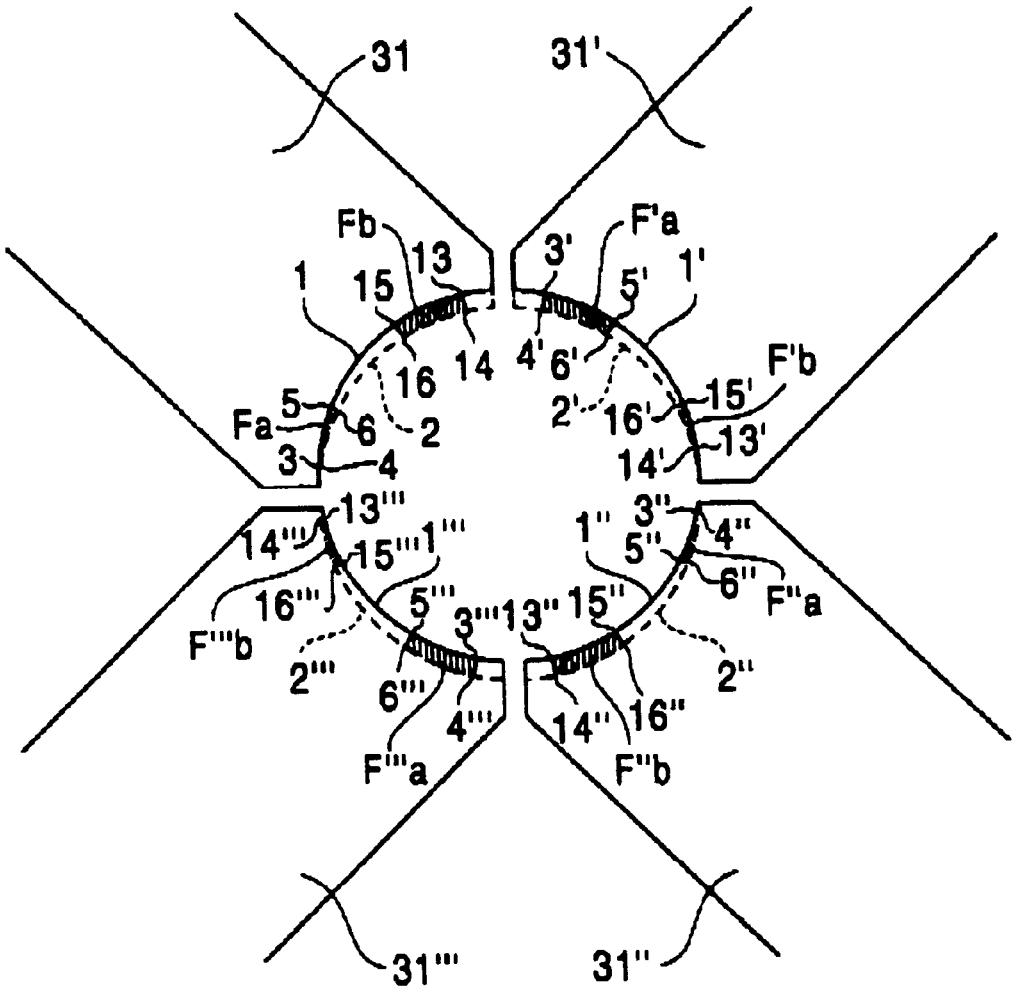
FIG. 6 illustrates roll calibers according to an exemplary embodiment of the present invention in a four-roll rolling mill.

Further, the method of the present invention can be also applied to a three-roll rolling mill and a four-roll rolling mill. FIG. 5 shows the calibers of an embodiment of a three-roll rolling mill. FIG. 6 shows the calibers of an embodiment of a four-roll rolling mill. Similar numerals as used in FIG. 4 are used in FIGS. 5 and 6. The procedures used in these three-roll and four-roll rolling mills are the same as those used in the two-roll rolling mill and the number of repetitions of the procedures is changed depending upon the number of rolls.

In the three-roll rolling mill in which the caliber for 50 mmϕ bar steel product was employed, it took three minutes to process three rolls using the portions 1.0 mm and 5.0 mm from both of the ends of the rolls as sensing positions until $S_R \leqq 0.4$ and $S_a \leqq 0.2$. The deviation of a rolled material diameter was less than 1 mm during this time. It required twenty minutes of working time for a skilled worker to obtain the same degree of dimensional accuracy visually.

In the four-roll rolling mill in which the caliber for 50 mmϕ bar steel product was employed, it took five minutes to process four rolls using the portions 1.0 mm and 4.0 mm from both of the ends of the rolls as sensing positions until $S_R \leqq 0.4$ and $S_A \leqq 0.2$. The deviation of a rolled material diameter was less than 1.0 mm during this time. It required twenty-five minutes of working time for a skilled worker to obtain the same degree of dimensional accuracy visually.

In general, the caliber of a roll for rolling bar steel has a complex overall shape. However, in the method of the embodiment, the profile of the caliber at the center of the caliber is not included in the sensing positions. Thus, the profile of an overall roll caliber need not be necessarily extracted in the image processing. As a result, the image processing can be effectively carried out by extracting a profile of only a portion of the roll caliber. Moreover, the location discrepancy of a roll and the dislocating direction of the roll can be provided as guidances by the sum of, and the difference between, the areas Fa and Fb, which are calculated from the profiles at the sensing positions. Accordingly, the cost of the overall apparatus can be reduced.

Further, the portions of the roll caliber that are less worn by rolling are used as the sensing positions of the embodiment. Therefore, an error due to wear can be reduced to a low level, and an accurate position of the roll can be determined.

In addition, the material escaping portion used as the sensing position of the embodiment has an approximately linear or smooth curved profile. Thus, it is also possible to simplify calculations by approximating Fa and Fb by the areas Fa' and Fb' of the squares, which are surrounded by four coordinates in total; that is, the coordinates at both of the ends of the reference profile and the coordinates at both of the ends of the actually measured profile.

Further, in the embodiment, a worker adjusts a roll position based on the values displayed on the display 37 in FIG. 3. However, the fine adjustment of the roll position may be automatically carried out by operating a roll position adjusting apparatus in association with the value output from the guidance calculating device 36 in FIG. 3.

As described above, an amount of adjustment of a roll position can be accurately determined by the present invention, which can have a simple arrangement. As a result, the roll position can be simply and accurately adjusted. In particular, the use of the material escaping portion, having a small degree of wear due to rolling and a non-complex profile, as the sensing position can further enhance the accuracy of the amount of adjustment of the roll position.

What is claimed is:

1. A method of adjusting a roll position in a bar steel rolling mill, comprising:

(a) illuminating a caliber of a roll;

(b) inputting video signals of sensing positions of the roll caliber located at portions of the roll caliber located approximately symmetrically with respect to a rolling reduction direction of the roll;

(c) determining actually measured profiles of the sensing positions based on the video signals; and (d) determining a first guidance in the rolling reduction direction from the sum of the areas located between the actually measured profiles and the reference profiles at the sensing positions;

(e) determining a second guidance in the roll axial direction from the difference between the areas located between the actually measured profiles and the reference profiles at the sensing positions; and (f) adjusting the roll position in the rolling reduction direction and the roll axial direction based on the first guidance and the second guidance, respectively.

2. The method of claim 1, wherein the bar steel rolling mill is a two-roll rolling mill.

3. The method of claim 1, wherein the bar steel rolling mill is a three-roll rolling mill.

4. The method of claim 1, wherein the bar steel rolling mill is a four-roll rolling mill.

5. The method of claim 1, wherein the sensing positions are located at material escaping portions at each of two opposed ends of the roll in an axial direction of the roll.

6. The method of claim 1, further comprising repeating steps (a)–(f) until absolute values of the first and second guidances are equal to a value within a desired range.

7. The method of claim 6, wherein the value is zero.

8. A roll position adjusting guidance apparatus, comprising:

an illuminating device that illuminates a caliber of a roll;

a video signal input device that inputs video signals of sensing positions of the roll caliber at portions of the roll caliber located approximately symmetrically with respect to a rolling reduction direction of the roll;

an image processing apparatus that determines actually measured profiles of the sensing positions based on the video signals; and a determining device that determines (a) a guidance in the rolling reduction direction from the sum of the areas located between the actually measured profiles and the reference profiles at the sensing positions, and (b) a guidance in the roll axial direction from the difference between the areas located between the actually measured profiles and the reference profiles at the sensing positions.

9. A method of adjusting a roll position in a bar steel rolling mill, comprising:

selecting two portions of a caliber of a roll as sensing positions, the two portions being located at approximately symmetrical positions with respect to a rolling reduction direction of the roll;

determining the sum of, and the difference between, areas located between a reference profile and an actually measured profile at the sensing positions; and adjusting the roll position based on the determined sum of, and the difference between, the areas located between the reference profile and the actually measured profile at the sensing positions.

10. The method of claim 9, wherein the bar steel rolling mill is a two-roll rolling mill.

11. The method of claim 9, wherein the bar steel rolling mill is a three-roll rolling mill.

12. The method of claim 9, wherein the bar steel rolling mill is a four-roll rolling mill.

13. The method of claim 9, wherein the sensing positions are located at material escaping portions at each of two opposed ends of the roll in an axial direction of the roll.

14. The method of claim 9, wherein the actually measured profiles at the sensing positions of the roll are determined by inputting the video signals of the sensing positions, and subjecting the video signals at the sensing positions to image processing.

15. The method of claim 9, further comprising:

determining a first guidance in the rolling reduction direction from the sum of the areas located between the actually measured profiles and the reference profiles at the sensing positions;

determining a second guidance in the roll axial direction from the difference between the areas located between the actually measured profiles and the reference profiles at the sensing positions; and adjusting the roll position in the rolling reduction direction and the roll axial direction based on the first guidance and the second guidance, respectively.

* * * * *